US008944568B2

(12) United States Patent
Kajiura

(10) Patent No.: US 8,944,568 B2
(45) Date of Patent: Feb. 3, 2015

(54) PRINTHEAD AND METHOD OF MANUFACTURING PRINTHEAD

(75) Inventor: Morimasa Kajiura, Ichinomiya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 1164 days.

(21) Appl. No.: 12/892,380

(22) Filed: Sep. 28, 2010

(65) Prior Publication Data

US 2011/0134191 A1 Jun. 9, 2011

(30) Foreign Application Priority Data

Dec. 8, 2009 (JP) ..... 2009-278408

(51) Int. Cl.
*B41J 2/05* (2006.01)
*B41J 2/14* (2006.01)
*B41J 2/045* (2006.01)

(52) U.S. Cl.
CPC ..... *B41J 2/14233* (2013.01)
USPC ..... 347/58; 347/50; 347/71

(58) Field of Classification Search
None
See application file for complete search history.

(56) References Cited

U.S. PATENT DOCUMENTS

2003/0112298 A1 6/2003 Sato et al.
2004/0130604 A1* 7/2004 Watanabe et al. ..... 347/71
2005/0041074 A1* 2/2005 Watanabe et al. ..... 347/71
2005/0062806 A1* 3/2005 Terakura et al. ..... 347/72
2005/0237365 A1 10/2005 Hiwada
2006/0226200 A1 10/2006 Banno et al.
2007/0144000 A1 6/2007 Hirota et al.
2007/0229606 A1* 10/2007 Taira et al. ..... 347/71

FOREIGN PATENT DOCUMENTS

JP 2003-69103 A 3/2003
JP 2004-114342 A 4/2004
JP 2005-88570 A 4/2005
JP 2005-305982 A 11/2005
JP 2006-278964 A 10/2006
JP 2006-346867 12/2006
JP 2007-168360 7/2007

(Continued)

OTHER PUBLICATIONS

Notice of Reasons for Rejection dated Mar. 19, 2013 received from the Japanese Patent Office in related application 2009-278408 together with English translation.

(Continued)

*Primary Examiner* — Geoffrey Mruk
(74) *Attorney, Agent, or Firm* — Scully, Scott, Murphy & Presser, P.C.

(57) ABSTRACT

A printhead may include a flow channel unit configured to discharge liquid. The printhead may include an actuator unit configured to apply discharge energy to the liquid in the flow channel unit. The printhead may include a flat flexible substrate connected to the actuator unit and configured to supply a drive signal to the actuator unit. The printhead may include a plurality of contact points disposed in an outline of the actuator unit in plan view and configured to electrically connect the actuator unit and the flat flexible substrate. The printhead may include a reinforcing member configured to fix a reinforcing portion, which includes at least part of an outer periphery of the actuator unit and the flat flexible substrate.

10 Claims, 13 Drawing Sheets

(56) References Cited

FOREIGN PATENT DOCUMENTS

| | | | |
|---|---|---|---|
| JP | 2007-237474 | A | 9/2007 |
| JP | 2007-268849 | A | 10/2007 |
| JP | 2009-78564 | A | 4/2009 |
| JP | 2009-241508 | A | 10/2009 |

OTHER PUBLICATIONS

Notice of Reasons for Rejection dated Jun. 24, 2014 received from the Japanese Patent Office in related application 2013-140663 together with English translation.

* cited by examiner

PRINTHEAD AND METHOD OF MANUFACTURING PRINTHEAD

CROSS REFERENCE TO RELATED APPLICATION

This application claims priority to Japanese Patent Application No. 2009-278408, filed Dec. 8, 2009, the entire subject matter and disclosure of which is incorporated herein by reference.

BACKGROUND OF THE DISCLOSURE

1. Field of the Disclosure

The features described herein relate generally to a printhead provided in a printing device which performs printing on a printing medium by discharging liquid therefrom, and a method of manufacturing same.

2. Description of Related Art

A known printhead includes an actuator unit and a flat flexible substrate (FPC) fixed to the actuator unit. The actuator unit includes a piezoelectric layer extending over a number of pressure chambers, and a number of individual electrodes and a number of bumps both provided on a surface of the piezoelectric layer. A number of the individual electrodes are arranged so as to oppose the respective pressure chambers, and are electrically connected to the respective bumps. The FPC is configured to supply drive signals to the actuator unit, and includes a number of lands and a plurality of wirings connected respectively to a number of the lands. The actuator unit and the FPC are fixed to each other by mutual joint between a number of the bumps provided on the actuator unit and a number of the lands provided on the FPC.

The FPC and the actuator unit have different coefficients of thermal expansion. Therefore, for example, the FPC may expand or contract significantly in comparison with the actuator unit due to, for example, variations in working temperature of the printhead or temperature variations in association with natural cooling after a heating step at the time of manufacture. If the expansion or the contraction of the FPC occurs, the contact points between the lands and the bumps, at which the FPC and the actuator unit are fixed to each other, are respectively subject to a force inward or outward of the FPC with respect to the horizontal direction. Accordingly, a stress may concentrate to the contact points between the lands and the bumps to break the contact points.

SUMMARY OF THE DISCLOSURE

According to one embodiment herein, a printhead may include a flow channel unit configured to discharge liquid. The printhead may include an actuator unit configured to apply discharge energy to the liquid in the flow channel unit. The printhead may include a flat flexible substrate connected to the actuator unit and configured to supply a drive signal to the actuator unit. The printhead may include a plurality of contact points disposed in an outline of the actuator unit in plan view and configured to electrically connect the actuator unit and the flat flexible substrate. The printhead may include a reinforcing member configured to fix a reinforcing portion, which includes at least part of an outer periphery of the actuator unit and the flat flexible substrate.

According to another embodiment herein, a method of manufacturing a printhead comprising; a flow channel unit configured to discharge liquid, an actuator unit configured to apply discharging energy to the liquid in the flow channel unit, a flat flexible substrate connected to the actuator unit and configured to supply a drive signal to the actuator unit, and a plurality of contact points disposed in an outline of the actuator unit in plan view and configured to electrically connect the actuator unit and the flat flexible substrate, the method may include the step of forming a reinforcing member including a heat-cured adhesive agent in a semi-cured state in a reinforcing portion, which is at least part of an outer periphery of the actuator unit or at a position corresponding to the reinforcing portion on the flat flexible substrate. The method of manufacturing the printhead may include the step of fixing the actuator unit and the flat flexible substrate by heating to cure the reinforcing member, in a state in which the flat flexible substrate and the reinforcing member are in contact with each other and the reinforcing member and the reinforcing portion are in contact with each other.

Other objects, features and advantages will be apparent to persons of ordinary skill in the art from the following description with reference to the accompanying drawings.

DETAILED DESCRIPTION

Various embodiments, and their features and advantages, may be understood by referring to FIGS. 1-13, like numerals being used for corresponding parts in the various drawings.

Figure 1:
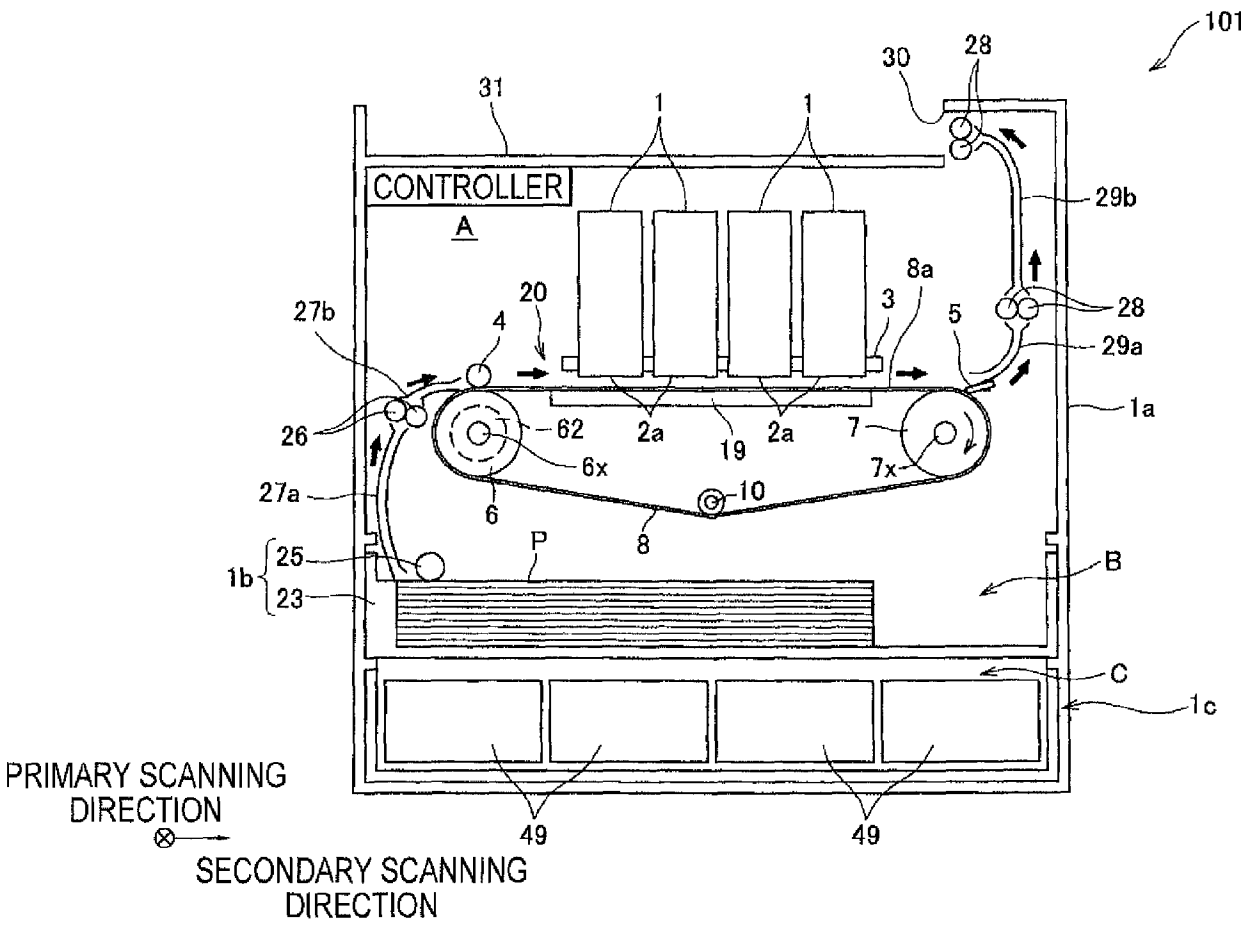
FIG. 1 is a cross-sectional view of an ink-jet printer according to an embodiment.

Referring to FIG. 1, an ink-jet printer 101 according to an embodiment may include a rectangular box-shaped casing 1*a*. The casing 1*a* may include a paper output portion 31 on the top thereof. The interior of the casing 1*a* may be divided into a plurality of, e.g., three, spaces A, B, and C in sequence from the top. The spaces A and B may be spaces having a paper transporting path continuing to the paper output portion 31 formed therein. In the space A, paper transport and image formation on the paper may be performed. In the space B, paper feeding may be performed. In the space C, ink supply sources may be stored and supply of ink may be performed.

In the space A, a plurality of, e.g., four, ink-jet heads 1, a transporting unit 20 configured to transport a paper, and a guide unit configured to guide the paper may be disposed. A controller which controls the action of the entire printer including these mechanisms may be disposed in an upper portion of the space A.

The plurality of, e.g., four, ink-jet heads 1 may be line heads elongated in a primary scanning direction. Each ink-jet head 1 may have an outside shape of substantially rectangular block. The respective ink-jet heads 1 may be arranged in a secondary scanning direction at a predetermined pitch, and may be supported in the casing 1*a* with a head frame 3. The ink-jet head 1 may include a flow channel unit 9, a plurality of, e.g., four, actuator units 17, and a reservoir unit 71. The plurality of, e.g., four, ink-jet heads 1 may discharge ink in magenta, cyan, yellow, and black from respective lower surfaces (i.e., discharging surfaces 2*a*) thereof.

The transporting unit 20 may include belt rollers 6 and 7, an endless transporting belt 8 wound around the both rollers 6 and 7 so as to extend therebetween, a nip roller 4 and a separation plate 5 arranged outside the transporting belt 8, and a platen 19 and a tension roller 10 arranged inside the transporting belt 8. The belt roller 7 may be a drive roller and may rotate clockwise in FIG. 1 using a transporting motor (not shown). At this time, the transporting belt 8 may travel along thick arrows in FIG. 1. The belt roller 6 may be a driven roller and may be rotated clockwise in FIG. 1 with the travel of the transporting belt B. The nip roller 4 may be disposed so as to oppose the belt roller 6 for pressing a paper P supplied from the guide unit on the upstream side thereof against a peripheral surface 8*a* of the transporting belt 8. The separation plate 5 may be disposed so as to oppose the belt roller 7 for separating the paper P from the peripheral surface 8*a* and guiding the same to the guide unit on the downstream side thereof. The platen 19 may be disposed so as to oppose the plurality of, e.g., four, ink-jet heads 1, and may support an upper loop of the transporting belt 8 from inside thereof. Accordingly, a predetermined distance suitable for the image formation may be formed between the peripheral surface 8*a* and the discharging surfaces 2*a* of the ink-jet heads 1. The tension roller 10 may urge a lower loop downward. Accordingly, sagging of the transporting belt may be eliminated.

The guide units may be arranged on both sides of the transporting unit 20. The upstream guide unit may include a plurality of, e.g., two, guides 27*a* and 27*b* and a pair of feed rollers 26. The guide unit may connect a paper feed unit 1*b* and the transporting unit 20. The downstream guide unit may include a plurality of, e.g., two, guides 29*a* and 29*b* and a plurality of, e.g., two, pairs of feed rollers 28. This guide unit may connect the transporting unit 20 and the paper output portion 31.

In the space B, the paper feed unit 1*b* may be disposed so as to be demountable with respect to the casing 1*a*. The paper feed unit 1*b* may include a paper feed tray 23 and a paper feed roller 25. The paper feed tray 23 may have a box shape opening upward, and may accommodate a plurality of papers P therein. The paper feed roller 25 may feed the upper most paper P in the paper feed tray 23 and may deliver the same to the guide unit on the downstream side.

As described above, the paper transporting path from the paper feed unit 1*b* to the paper output portion 31 via the transporting unit 20 may be defined by the space A and the space B. The controller may drive a motor for paper feeding roller (not shown) of the paper feed unit 1*b*, motors for feeding rollers of the respective guide units (not shown), and a transporting motor (not shown) of the transporting unit 20 on the basis of printing commands. The paper P delivered from the paper feed tray 23 may be supplied to the transporting unit 20 by the feed rollers 26. When the paper P passes right under the respective ink-jet heads in the secondary scanning direction, ink may be discharged from the ink-jet heads 1 in sequence to form a color image on the paper P. The paper P may be separated on the right side of the transporting belt 8, and may be transported upward by the plurality of, e.g., two, feed rollers 28. Transportation of the paper P by the respective guide units may extend along the guides 27*a* and 27*b* and the guides 29*a* and 29*b*. The paper P may be discharged from an opening 30 provided above to the paper output portion 31.

The secondary scanning direction means a direction parallel to the transporting direction in which the paper P is transported in the transporting unit 20. The primary scanning direction means a direction parallel to the horizontal direction and orthogonal to the secondary scanning direction.

The space C may include an ink tank unit 1*c* arranged so as to be demountable with respect to the casing 1*a*. A plurality of, e.g., four, ink tanks 49 may be stored in the ink tank unit 1*c* so as to be arranged in line. Ink in each of the ink tank 49 may be supplied to the corresponding ink-jet head 1 via a tube (not shown).

Figure 2:
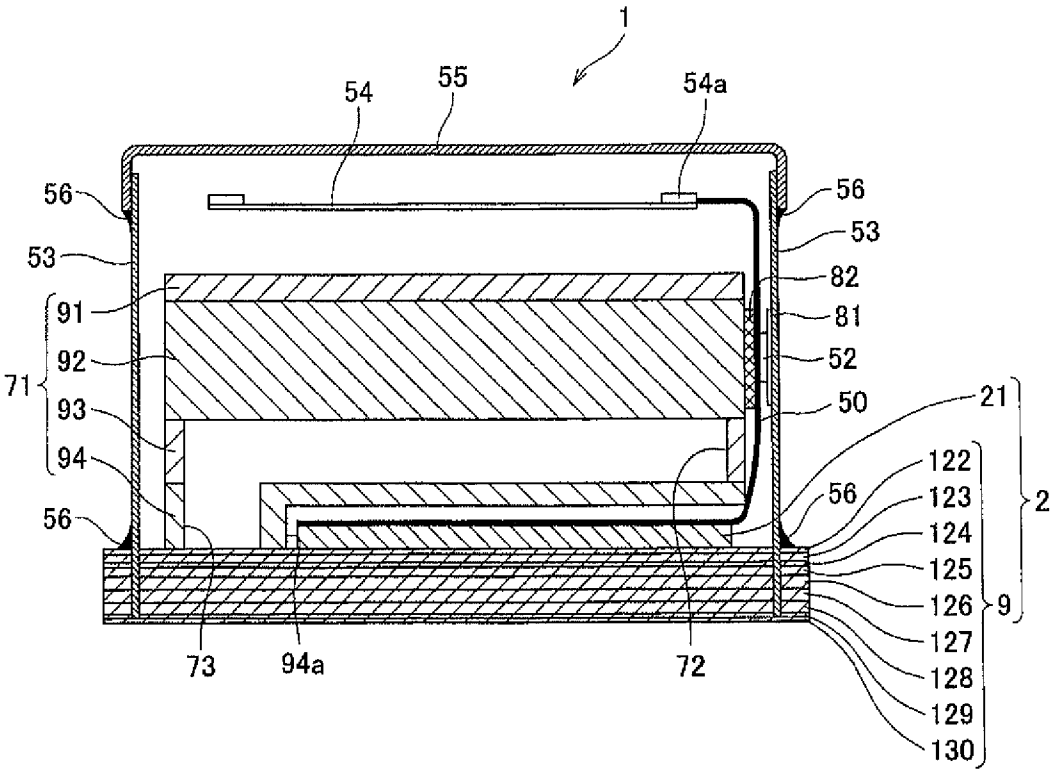
FIG. 2 is a cross-sectional view taken along the short-side direction of the ink-jet head shown in FIG. 1.

Referring to FIG. 2, the ink-jet head 1 may include a flow channel forming member, an electrical member, and a cover member. The flow channel forming member may be a laminated member having an ink flow channel formed therein, and ink from the ink tank 49 may be filled therein. The electrical member may be involved in discharge of ink in the ink flow channel. The cover member may mainly protect the electrical member from the outside.

The flow channel forming member may be a laminated member including the reservoir unit 71 on the upper side and a head body 2 on the lower side. The head body 2 may include actuator units 21, which are also the electrical members.

The reservoir unit 71 may be a laminated member including a plurality of, e.g., four, metallic plates 91 to 94, and may have a rectangular block shape as a whole. The plate 94 may be formed with a plurality of protrusions 94*a* on a lower surface thereof. Distal end surfaces of the protrusions 94*a* may be joint surfaces with respect to the flow channel unit 9. Depressed portions defined by the protrusions 94*a* may form a gap with respect to the flow channel unit 9. The reservoir unit 71 may include an ink reservoir 72 formed in the interior thereof and ink from the ink tank 49 may be stored therein. The protrusions 94*a* each may be formed with an ink outflow channel 73 communicating with the ink reservoir 72, which opens at the distal end surface thereof. There may be a plurality of, e.g., ten. ink outflow channels 73.

Figure 3:
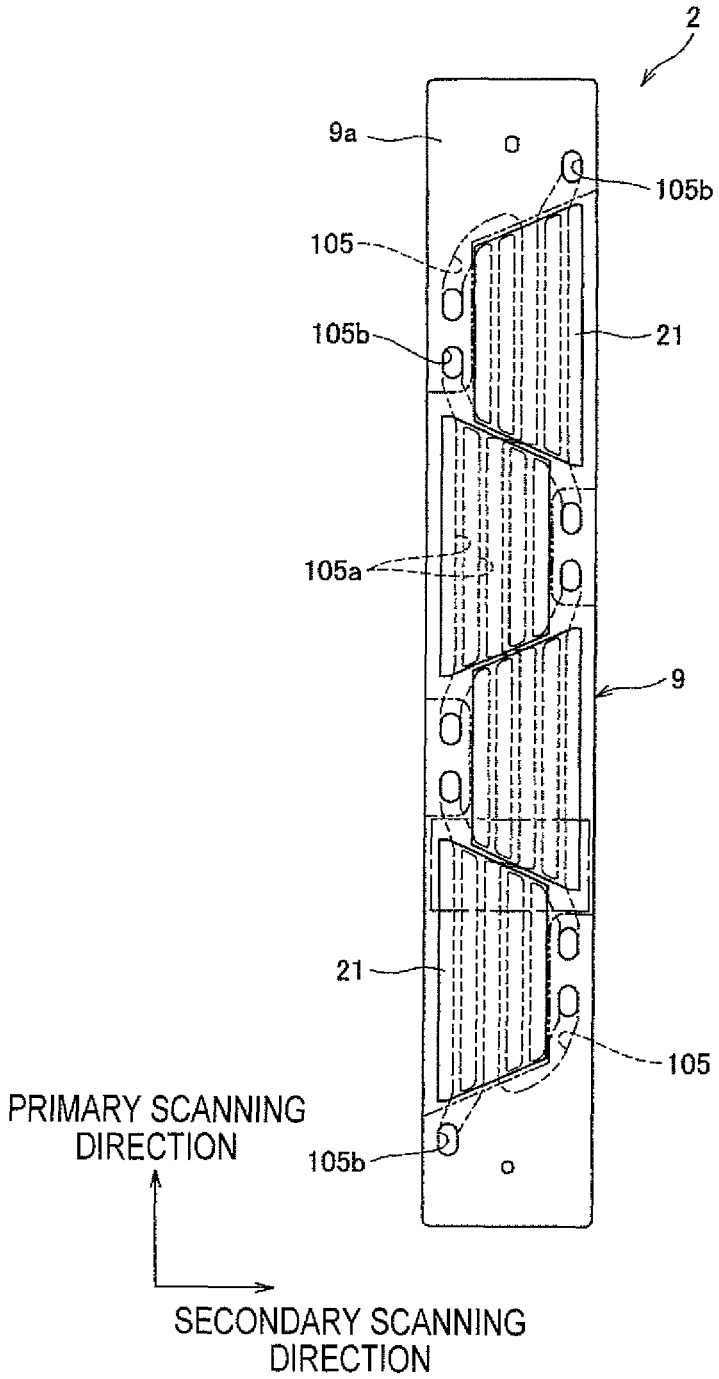
FIG. 3 is a plan view of a head body shown in FIG. 2.

Referring to FIG. 3, the head body 2 may include the flow channel unit 9 and the actuator units 21. The flow channel unit 9 may be a laminated member including a plurality of, e.g., nine, metallic plates 122 to 130 as shown in FIG. 5, and may have a rectangular block shape as a whole. A lower surface of the flow channel unit 9 may correspond to the discharging surface 2*a* including a plurality of nozzles 108 opened therefrom. An upper surface of the flow channel unit 9 may be a joint surface including a plurality of pressure chambers 110 (see FIG. 4) and a plurality of, e.g., ten, ink supply ports 105*b* opened therefrom. On the upper surface of the flow channel unit 9, the protrusions 94*a* of the plate 94 may be joined corresponding to the ink supply ports 105*b* and also the actuator units 21 may be joined corresponding to a pressure chamber groups (a group of a plurality of the pressure chambers 110). Accordingly, the ink supply ports 105*b* may fluidly communicate with the ink outflow channels 73 of the reservoir unit 71. The actuator units 21 may seal the openings of the plurality of pressure chambers 110 and may also function as wall members of the ink flow channels.

Figure 4:
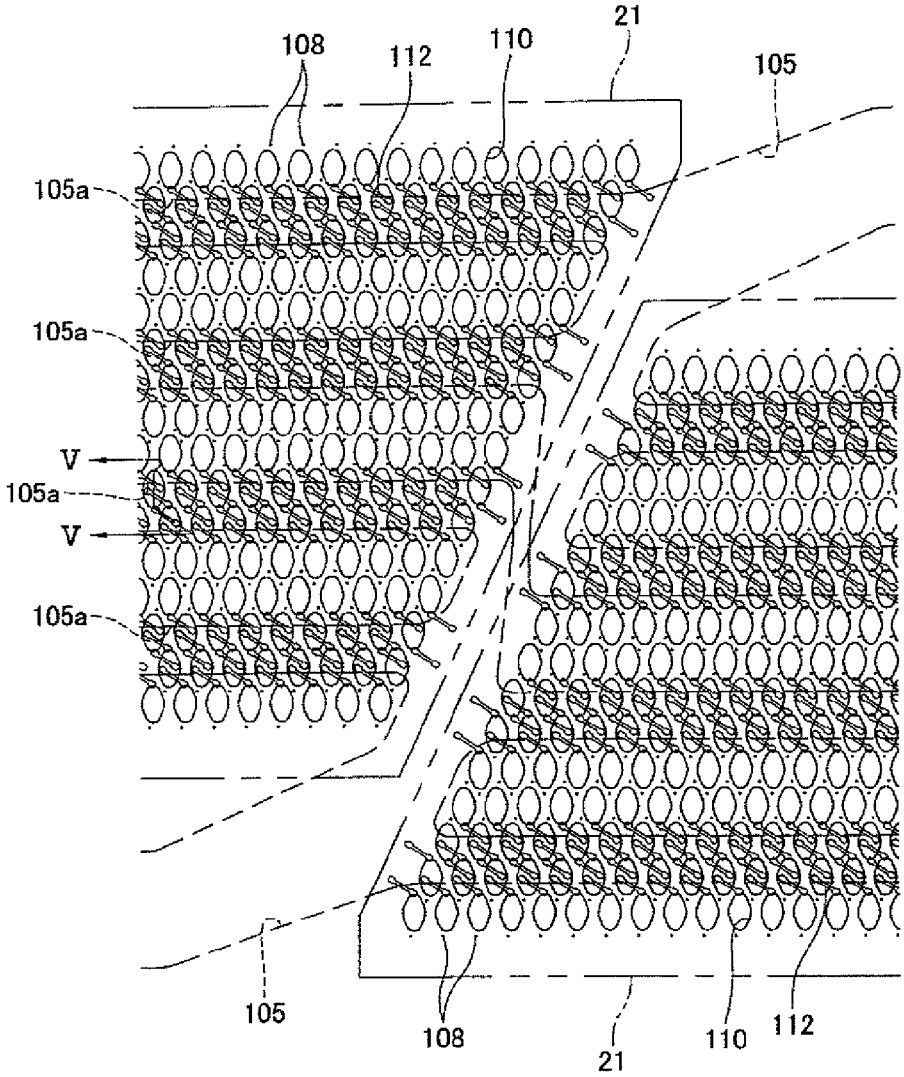
FIG. 4 is an enlarged view of an area surrounded by an alternate long and short dash line shown in FIG. 3.
Figure 5:
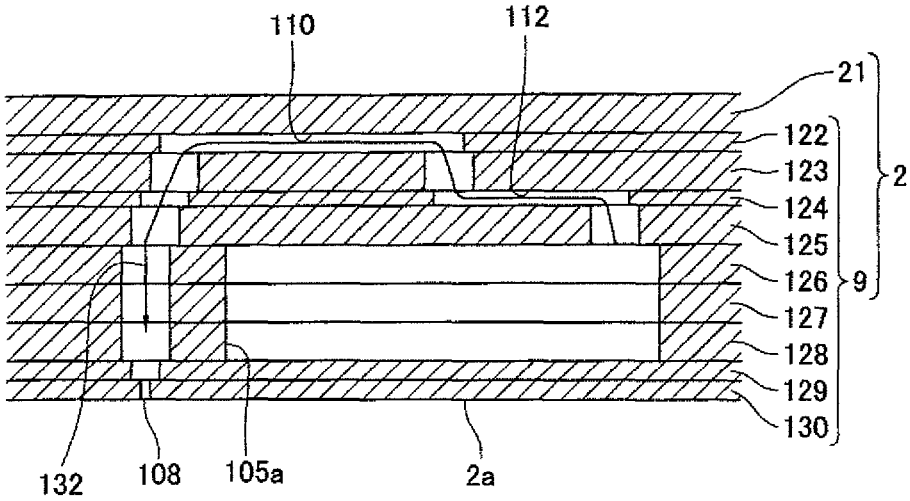
FIG. 5 is a cross-sectional view taken along the line V-V in FIG. 4.

The flow channel unit 9 may be formed in the interior thereof with an ink flow channel extending from the ink supply ports 105*b* to the nozzles 108 as shown in FIG. 4. The ink flow channel may include manifold flow channels 105 communicating with the ink supply ports 105*b*, secondary manifold flow channels 105*a* branched from the manifold flow channels 105, and a plurality of individual ink flow channels 132 extending from outlet ports of the secondary manifold flow channels 105*a* to the nozzles 108. The individual ink flow channels 132 may be channels including the pressure chambers 110 and the secondary manifold flow channels 105*a* connected by apertures 112, respectively. The pressure chambers 110 of the pressure chamber group may be, as shown in FIG. 3 and FIG. 4, arranged in a matrix pattern and occupy a trapezoidal area similar to the actuator unit 21.

The actuator unit 21 may be a sheet-shaped member having a substantially trapezoidal shape in plan view. The actuator unit 21 may be a laminated member including a plurality of, e.g., three, piezoelectric sheets 141 to 143. The piezoelectric sheets 141 to 143 may include ferroelectric ceramics material on the basis of lead zirconate titanate (PZT). The plurality of, e.g., four, actuator units 21 may be arranged in a plurality of, e.g., two, rows in the primary scanning direction in a zigzag pattern. The plurality of, e.g., four, actuator units 21 may be joined to the upper surface of the flow channel unit 9. The parallel opposed sides of the trapezoid may extend along the primary scanning direction. The actuator units 21 may be arranged between the ink supply ports 105*b* which are positioned at both sides thereof in the primary scanning direction. The actuator unit 21 may be stored in a gap defined by the lower surface of the plate 94 and the upper surface of the flow channel unit 9. The actuator units 21 may be deformed by drive signals from a driver IC 52, and may apply pressure to the ink in the pressure chambers 110.

The electrical member may include a control board 54 and COFs 50 in addition to the actuator units 21. The control board 54 may include a plurality of electronic components mounted thereon and may output print data. The COF 50 may be a flat flexible substrate including the driver IC 52 mounted at the midsection thereof. The COF 50 may be connected at one end thereof to a connector 54*a* on the control board 54 and at the other end to upper surface of the actuator unit 21. When the print data is supplied from the control board 54, drive signals for the actuator unit 21 may be supplied from the driver IC 52.

The cover member may be a box member including a side cover 53 including metal and a head cover 55 including resin. The cover member may be fixed to the flow channel unit 9 at a lower end of the side cover 53. In a space defined by the cover member and the flow channel unit 9, the reservoir unit 71 and the electrical members may be stored. Accordingly, entry of ink mist from the outside may be avoided, such that electrical problems do not occur on the electrical members. The side cover 53 may include aluminum having good heat dissipation properties. Referring back to FIG. 2, the side cover 53 may be thermally connected to the driver IC 52 via a heat-discharging sheet 81. A sponge 82 may be fixed to a side surface of the reservoir unit 71, and the driver IC 52 may be urged toward the side cover 53.

Referring to FIG. 3 and FIG. 4, the plurality of, e.g., four, actuator units 21 each may be formed into a hexagonal shape formed by cutting corners at an acute angle of a trapezoid off. The actuator unit 21 may include a short side and a long side extending in parallel to the longitudinal direction of the flow channel unit 9, two oblique sides opposing each other, and two short sides extending in parallel to the short side direction. The two short sides each are connected to one end of the oblique side and one end of the long side and are very short in comparison with the oblique side. Therefore, the actuator unit 21 may have a substantially trapezoidal shape. Accordingly, the breakage of the actuator units 21 which may occur often during manufacture of the ink-jet head 1 may be avoided. The two oblique sides of the two adjacent actuator units 21, which are opposed to each other, may be overlapped with each other in the width direction of the flow channel unit 9 (i.e., the secondary scanning direction).

Figure 6A:
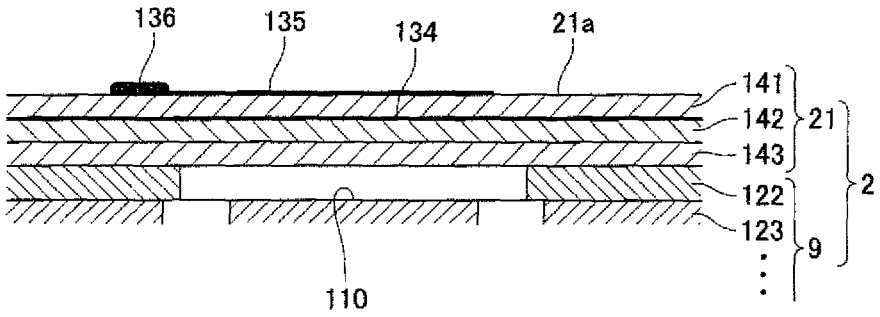
FIGS. 6A and 6B are explanatory drawings showing an actuator unit shown in FIG. 4.

Referring to FIG. 6A, a lower surface of a lowermost piezoelectric sheet 143 of the actuator unit 21 may be fixed to the flow channel unit 9. Individual electrodes 135 opposing the pressure chambers 110 may be disposed on an upper surface (i.e., surface 21*a*) of the piezoelectric sheet 141. A common electrode 134 which extends over the entire surface of the sheet may be interposed between the piezoelectric sheet 141 and the piezoelectric sheet 142 immediately below the piezoelectric sheet 141.

Figure 6B:
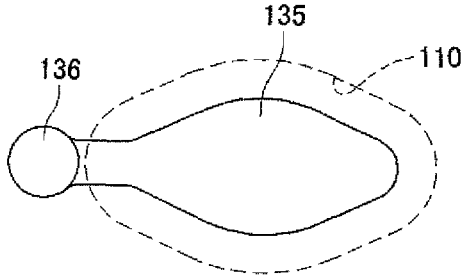

Referring to FIG. 6B, the outer shape of the each individual electrode 135 may be a substantially diamond shape as a whole, which is similar to that of the pressure chamber 110. The individual electrode 135 may include the diamond-shaped portion, a drawn portion connected to one of portions having an acute angle of the diamond-shaped portion, and an individual bump 136 arranged at a distal end of the drawn portion. In plan view, the diamond-shaped portion may be included in the pressure chamber 110. The drawn portion may extend in the direction of longitudinal axis of the diamond-shaped portion and may have the distal end portion situated outside the pressure chamber 110. Therefore, the individual bump 136 may be not overlapped with the pressure chamber 110 in plan view. The individual bump 136 may be electrically connected to the individual electrode 135. The respective individual bumps 136 may be joined to respective lands 58 of the COF 50, and may receive supply of the drive signal from the driver IC 52. Therefore, the joint portions between the individual bumps 136 and the lands 58 may constitute contact points C which electrically connect the actuator unit 21 with the COF 50. The individual bump 136 for a common electrode, which is electrically connected to the common electrode 134 in addition to the individual bumps 136 for the individual electrodes, may be disposed on the surface 21*a*. The individual bump 136 for the common electrode may constitute a contact point together with the lands 58 on the COF 50.

Figure 9:
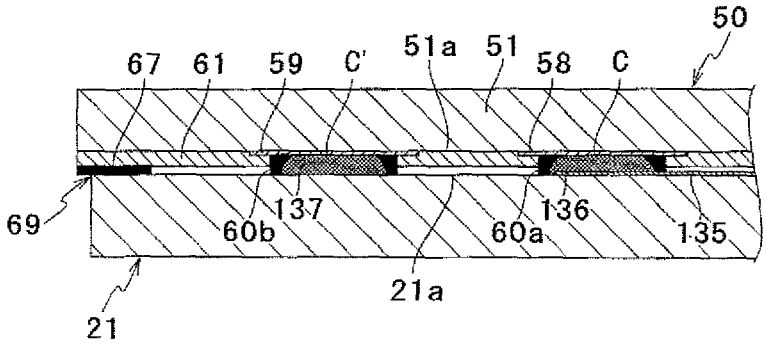
FIG. 9 is a cross-sectional view taken along the line IX-IX in FIG. 8.
Figure 10:
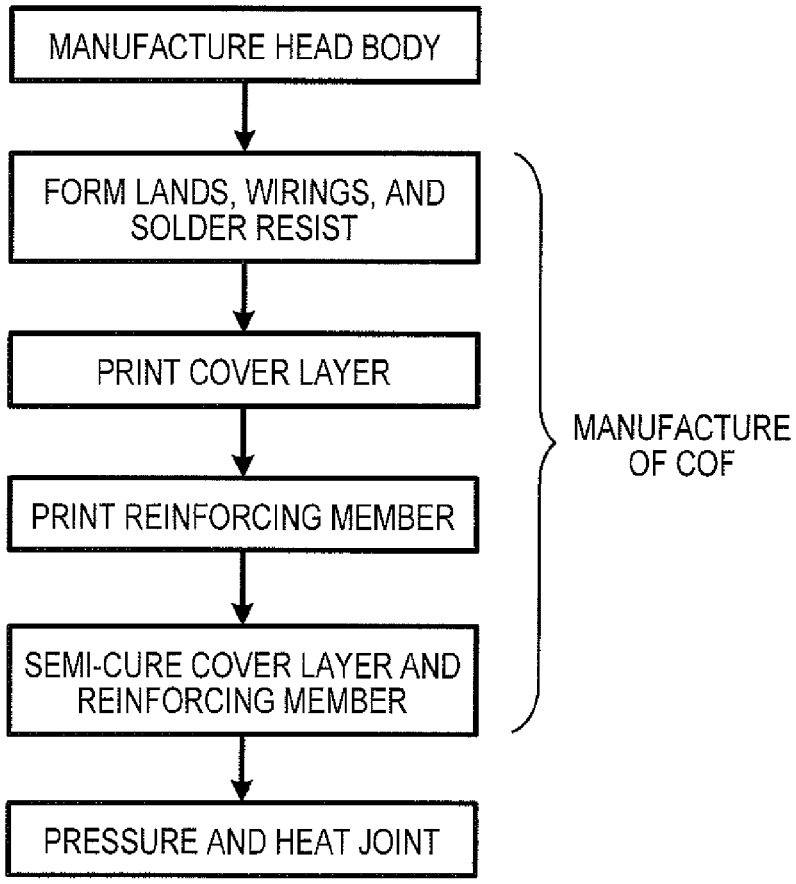
FIG. 10 is a block diagram for explaining steps of joining the COF shown in FIG. 2 to the actuator unit.

A plurality of dummy bumps 137 may be disposed along the periphery of the actuator unit 21 on the surface 21*a* of the piezoelectric sheet 141 (see FIG. 9). The respective dummy bumps 137 each may have the same shape as the individual bump 136, and may surround the individual bumps 136. The dummy bumps 137 may be disposed between the outermost individual bumps 136 and a reinforcing member 67 in plan view. The dummy bumps 137 each may include only a bump portion, and do not have the diamond-shaped portion and the drawn portion. The each dummy bump 137 may be joined to each dummy land 59 on the COF 50, but no drive signal from the driver IC 52 may be supplied. Therefore, the dummy bumps 137 and the dummy lands 59 may constitute dummy contact points C', which connect the actuator unit 21 and the COF 50 physically, but not electrically.

The contact points C may be arranged corresponding respectively to the pressure chambers 110 on the surface 21*a*, and may occupy a trapezoidal area in the same manner as the pressure chamber group. In plan view, the contact points C may be arranged at regular intervals in the trapezoidal area, and may constitute a plurality of rows extending in the primary scanning direction. The dummy contact points C' may be disposed along the outer edge of the trapezoidal area, and may have the same mapping rule as the contact points C. The positional relationship of the dummy contact point C' with respect to the adjacent contact point C may be the same as the positional relationship between the contact points C. In addition, there may be a band-shaped margin between the dummy contact points C' and the outer edge of the surface 21*a*, such that all the contact points C and the dummy contact points C' are surrounded by this margin.

The common electrode 134 may be provided with a ground potential via the contact point C for the common electrode. In contrast, the individual electrodes 135 may be electrically connected to respective output terminals of the driver IC 52 via the contact points C for the individual electrodes, and the drive signals may be selectively supplied.

Here, the piezoelectric sheet 141 may be polarized in the thickness direction. If the potential of the individual electrodes 135 is set to be different from that of the common electrode 134, an electric field may be generated in the direction of polarization, and hence the portions of the piezoelectric sheet 141 where the electric field is applied (i.e., active portions) may be deformed because of the piezoelectric effect. The active portions may be displaced in at least a vibrating mode selected from $d_{31}$, $d_{33}$, and $d_{15}$. In this embodiment, the active portions may be displaced in the vibrating mode of $d_{31}$. In contrast, the piezoelectric sheets 142 and 143 may be not spontaneously displaced even though they are portions corresponding to the individual electrodes 135 (i.e., non-active portions). Portions of this combination may function as a piezoelectric actuator of so-called unimorph type, and the actuators as many as the pressure chambers 110 may be built in the actuator unit 21.

A method of driving the actuator unit 21 will now be described. For example, if the direction of polarization is the same as the direction of application of the electric field, the active portions may be contracted in the direction orthogonal to the direction of polarization (i.e., direction of plane). In contrast, the two piezoelectric sheets 142 and 143 on the lower side may be not contracted because they are not affected by the electric field. At this time, there may arise a difference in deformation in the direction of plane between the active portions and the non-active portions. Therefore, the piezoelectric sheets 141 to 143 may be entirely deformed so as to protrude toward the pressure chambers 110 (i.e., unimorph deformation). Accordingly, a pressure (i.e., discharging energy) may be applied to the ink in the pressure chambers 110, such that ink drops are discharged from the nozzles 108.

The driver IC 52 may output a signal which causes a predetermined potential to be produced on the individual electrodes 135 in advance. The driver IC 52 may output a drive signal which brings the individual electrodes 135 into a ground potential once every time upon receipt of a discharge request, and then causes the predetermined potential to be produced on the individual electrodes 135 again at a predetermined timing. In this case, the piezoelectric sheets 141 to 143 may be restored to their original state at a timing when the individual electrodes 135 are brought into the ground potential. In association with increase in capacities of the pressure chambers (i.e., pressure lowering) at this time, ink may be sucked into the individual ink flow channels 132 from the secondary manifold flow channels 105*a*. Subsequently, at the timing when the predetermined potential is produced on the individual electrodes 135 again, the piezoelectric sheets 141 to 143 may be deformed so as to protrude toward the pressure chambers 110. In association with the reduction in capacities of the pressure chambers (i.e., pressure increase), ink may be discharged from the nozzles 108.

Figure 7:
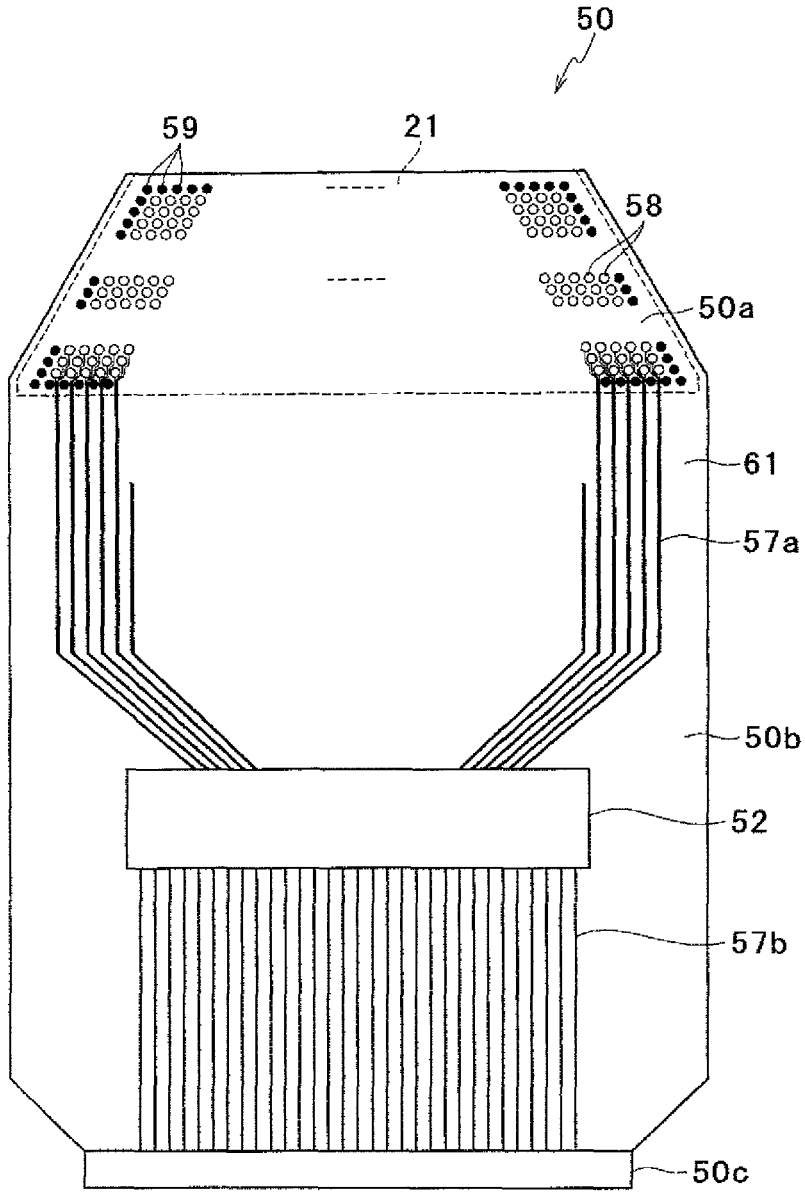
FIG. 7 is a plan view illustrating a surface of a COF shown in FIG. 2 having a driver IC mounted thereon.
Figure 8:
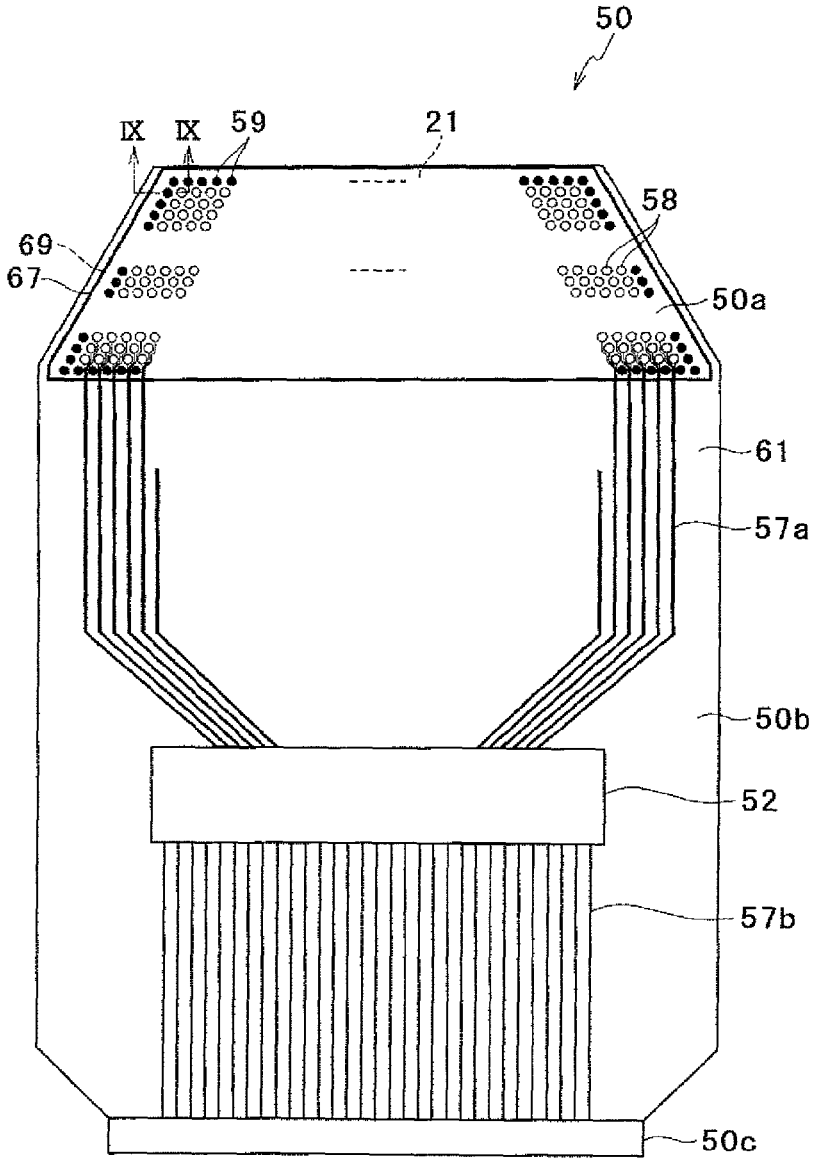
FIG. 8 is a drawing having a reinforcing member according to the embodiment added to a configuration shown in FIG. 7.

Referring to FIG. 7, the COF 50 may include a fixed portion 50*a* positioned near one end thereof and fixed to the actuator unit 21 and a non-fixed portion Sob which is not fixed to the actuator unit 21. The non-fixed portion 50*b* may extend beyond a long side (i.e., lower bottom) portion of the actuator unit 21. A distal end portion in the direction of extension may be a terminal 50*c*.

Referring to FIG. 9, the COF 50 may include a film-type base material 51. In the fixed portion 50*a*, a plurality of the lands 58 and a plurality of the dummy lands 59 may be disposed on a surface 51*a* of the base material 51. All of them may have the same circular shape. The plurality of lands 58 may be respectively positioned at positions opposing a plurality of the individual bumps 136, and may be joined to each other to constitute the contact points C, respectively. The plurality of lands 58 may be connected to a plurality of output wirings 57*a*, respectively. The plurality of dummy lands 59 may be respectively positioned at positions opposing the plurality of dummy bumps 137, and may be joined to each other to constitute the dummy contact points C', respectively. None of the dummy lands 59 may be connected to the output wirings 57*a*.

The driver IC 52 may be mounted on the non-fixed portion 50*b* of the COF 50 between the fixed portion 50*a* and the terminal 50*c*. The output wirings 57*a* extending from the lands 58 may be connected to output terminals (not shown) of the driver IC 52 respectively. Control wirings 57*b* extending from the terminals of the terminal 50*c* may be connected to control terminals (not shown) of the driver IC 52 respectively.

The dummy lands 59 positioned along the long sides of the actuator unit 21 may be arranged at regular intervals along a boundary between a group of the lands 58 and the non-fixed portion Sob in plan view. Referring back to FIG. 7 and FIG. 8, at the boundary, the plurality of output wirings 57*a* drawn on the non-fixed portion 50*b* may be disposed between the two dummy lands 59 adjacent to each other. The output wirings 57*a* may be bundled by several pieces at the boundary and in the vicinity thereof.

The COF 50 may include a solder resist 61 which is a layer for covering the plurality of output wirings 57*a* and control wirings 57*b*. The solder resist 61 may include heat-cured epoxy resin and may have an insulating property. The solder resist 61 may cover the entire part of the base material 51 except for portions where the plurality of lands 58 and dummy lands 59 are formed and a portion where the driver IC 52 is mounted. The thickness of the solder resist 61 may be smaller than the height of the individual bumps 136 and the dummy bumps 137. Therefore, a gap may be formed between the solder resist 61 and the surface 21*a* of the actuator unit 21. This gap may allow free unimorph deformation of the actuator unit 21.

Referring to FIG. 9, the COF 50 may include a contact point covering layer 60*a* and a dummy contact point covering layer 60*b* which cover the contact points C and the dummy contact points C'. The contact point covering layer 60*a* may cover the individual bumps 136 and the lands 58 over the entire circumferences thereof except for the joint portions thereof. The dummy contact point covering layer 60*b* may cover the dummy bumps 137 and the dummy lands 59 over the entire circumferences thereof except for the joint portions thereof. The covering layers 60*a* and 60*b* may include epoxy-based heat-cured resin which is a kind different from the solder resist 61, and has high electrical insulation properties. The covering layers 60*a* and 60*b* may extend from the surface 51*a* in the vicinities of proximal portions of the lands 58 and the dummy lands 59 to the surface 21*a* in the vicinities of proximal portions of the individual bumps 136 and the dummy bumps 137, and may fix the COF 50 to the actuator unit 21. The lands 58 and the dummy lands 59 may be thinner than the solder resist 61, and hence the contact points C and the dummy contact points C' may be configured by the individual bumps 136 and the dummy bumps 137 built in the COF 50 (i.e., the respective covering layers 60*a* and 60*b*) in the direction of thickness. At this time, the electric connection may be achieved by the abutment between the distal ends of the individual bumps 136 and the lands 58, and the physical connection may be achieved by the extension of the respective covering layers 60*a* and 60*b*.

Referring back to FIG. 8, the reinforcing member 67 is disposed over the entire circumference of a band-shaped outer periphery of the actuator unit 21 in plan view. More specifically, the reinforcing member 67 may exist from the outside of the plurality of dummy lands 59 to inside the outline of the actuator unit 21, and may be positioned along the outline. The reinforcing member 67 may be interposed between the outer periphery of the actuator unit 21 and the solder resist 61 and may be fixed to the both respectively as shown in FIG. 9. The reinforcing member 67 may include the same material as the covering layers 60*a* and 60*b*. A portion of the actuator unit 21 fixed to the reinforcing member 67, that is, the entire outer periphery of the actuator unit 21 may be a reinforcing portion 69.

Referring to FIG. 10 and FIGS. 11A to 11D, steps of manufacturing the COF 50 and fixing the same to the actuator unit 21 among the steps of manufacturing the ink-jet head 1 will be described.

First of all, the head body 2 may be manufactured. Manufacturing of the head body 2 may include a step of manufacturing the flow channel unit 9, a step of manufacturing the actuator unit 21, and a step of fixing the both. The step of creating the flow channel unit may include manufacture of the plates 122 to 130 by etching and fixation of the respective plates 122 to 130 by a heat-cured adhesive agent. The step of manufacturing the actuator unit 21 may include a step of forming the individual electrode 135 on the surface 21*a* and a step of forming the individual bumps 136 and the dummy bumps 137. In the step of fixing the both, a heat-cured adhesive agent may be used. In the step of forming the individual bumps 136 and the dummy bumps 137, the respective bumps 136 and 137 may be formed at a height of approximately 50 μm from the surface 21*a*. This height may be larger than the thickness of the solder resist 61.

Figure 11A:
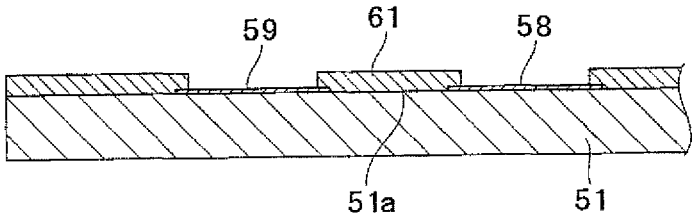
FIGS. 11A to 11D are explanatory drawings explaining respective steps shown in FIG. 10.

Subsequently, a step of manufacturing the COF 50 will be described. Referring to FIG. 11A, the plurality of lands 58 and dummy lands 59, the plurality of wirings including the output wirings 57*a* and the control wirings 57*b*, and mounting lands on which the driver IC 52 is mounted may be disposed on the surface 51*a* of the base material 51. Then, using photolithography, a pattern of the photoimageable solder resist 61 may be formed on the surface 51*a* so as to cover the output wirings 57*a* and the control wirings 57*b*. The procedure of formation of the pattern may be proceeded in the order of; application of solder resist, pre-curing of the applied layer (i.e., 80° C., 25 min.), exposure using a mask pattern, development, and post-curing of the patterned applied film (i.e., 150° C., 1 hour). In the application of the solder resist, the applied film may cover the respective wirings 57*a* and 57*b* including the respective lands 58 and 59. However, with the patterned applied film on the respective lands 58 and 59, center portions of the lands 58 and 59 may be exposed except for the peripheral edge portions of the respective lands 58 and 59. As the photoimageable solder resist 61, epoxy-based, acryl-based, and polyimide-based resin may be used. In this example, the epoxy-based resin is employed.

Figure 11B:
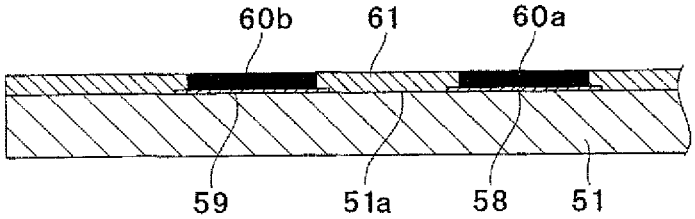

Referring to FIG. 11B, the heat-cured epoxy resin may be filled in depressed portions in which the plurality of lands 58 and dummy lands 59 are disposed as bottom surfaces by a printing method, thereby forming the contact point covering layer 60*a* and the dummy contact point covering layer 60*b* (i.e., cover layer printing). At this time, the contact point covering layer 60*a* and the dummy contact point covering layer 60*b* may come into contact with the solder resist 61 with respect to the in-plane direction of the surface 51*a*. Since the heat-cured epoxy resin has high viscosity, it may not flow out from the depressed portion even though it is not cured.

Figure 11C:
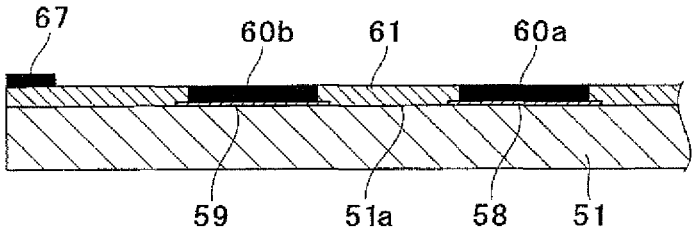

Referring to FIG. 11C, the reinforcing member 67 may be disposed at a position opposing the outer periphery of the actuator unit 21 of the fixed portion 50*a* by screen printing (i.e., reinforcing member printing). The reinforcing member 67 may have a shape along the outline of the actuator unit 21 and may be formed into a trapezoidal band shape. The material may be heat-cured epoxy resin, which is the same material as the covering layers 60*a* and 60*b*. A screen printing plate used in this case may include depressed portions on a lower surface thereof at positions opposing the contact point covering layer 60*a* and the dummy contact point covering layer 60*b*. Accordingly, the heat-cured epoxy resin filled as the covering layers 60*a* and 60*b* may be prevented from being transferred to the screen printing plate. Thereafter, a heating process for semi-curing the contact point covering layer 60*a* and the dummy contact point covering layer 60*b*, and the reinforcing member 67 may be performed, for example, at 100° C. for ten minutes (i.e., semi-curing of the covering layers and the reinforcing member). Then, the driver IC 52 may be mounted on the mounting land. Accordingly, the preparation of the COF 50 may be completed.

Figure 11D:
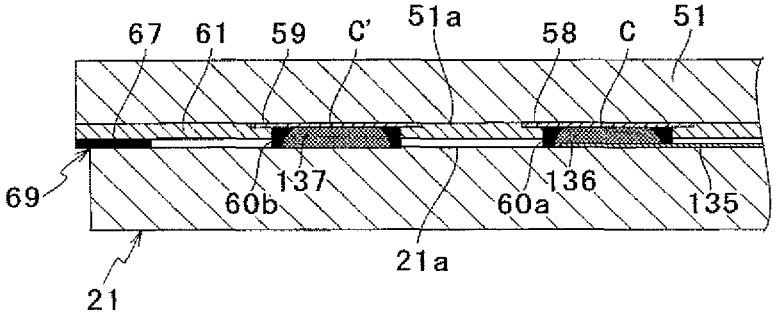

Referring to FIG. 11D, the surface 21*a* of the actuator unit 21 and the surface 51*a* of the COF 50 may be fixed to each other. When fixing, the both of them may be arranged so as to oppose with respect to each other in a predetermined relationship and pressurized so as to get close to each other. The COF 50 may be arranged above with respect to the vertical direction. At this time, the individual bumps 136 may penetrate through the contact point covering layer 60*a*, and the dummy bumps 137 may penetrate through the dummy contact point covering layer 60*b*. The individual bumps 136 may come into abutment with the land 58 while displacing the contact point covering layer 60*a*. In contrast, the dummy bumps 137 may displace the dummy contact point covering layer 60*b* and may come into abutment with the dummy land 59. The reinforcing member 67 on the surface 51*a* may come into contact with the reinforcing portion 69 of the actuator unit 21. In this pressurized state as well, the solder resist 61 may be apart from the surface 21*a*. In this state, for example, by applying the heating process at 200° C. for three minutes, the contact point covering layer 60*a*, the dummy contact point covering layer 60*b*, and the reinforcing member 67 may be cured. In the course of curing, the viscosity of the covering layers 60*a* and 60*b* may be lowered temporarily, and may spread over the surface 21*a* from the respective contact points. Accordingly, the respective contact points may be covered with the heat-cured epoxy resin over the entire circumferences. When the heating is further continued, the individual bumps 136 and the lands 58 may be joined to each other (i.e., contact points C), and the dummy bumps 137 and the dummy lands 59 may be joined to each other (i.e., dummy contact point C'). In addition, the reinforcing member 67 may be fixed to both the solder resist 61 and the actuator unit 21. Accordingly, the actuator unit 21 and the COF 50 may be fixed to each other (i.e., pressure and heat joint).

In this stage, the reservoir unit 71, the control board 54, and the covers 53 and 55 may be prepared via respective steps of manufacturing the same separately from the head body described above. Subsequently, following the step of manufacturing the head body 2 and the step of joining the COF 50 described above, the reservoir unit 71 may be joined. In the step of joining, the protrusions 94*a* of the reservoir unit 71 may be bonded to the upper surface of the flow channel unit 9. At this time, the ink outflow channels 73 of the reservoir unit 71 and the ink supply ports 105*b* of the flow channel unit 9 may be brought into fluid communication with each other. After having assembled the reservoir unit 71, the control board 54 may be fixed to an upper surface of the reservoir unit 71. The both may be secured with screws, not shown. Then, the actuator unit 21 and the control board 54 may be electrically connected. At this time, the terminal 50*c* of the COF 50 may be inserted into the connector 54*a* of the control board 54. Subsequently, the cover member may be fixed to the flow channel unit 9. In the step of fixing the cover member, the driver IC 52 may be arranged between the side cover 53 and a side surface of the reservoir unit 71 so as to be urged toward the side cover 53 with the sponge 82. A boundary between the upper surface of the flow channel unit 9 and the side cover 53, and a boundary between the covers 53 and 55 may be sealed with silicon resin. With the procedure as described above, the manufacture of the ink-jet head 1 may be completed.

According to the embodiment described above, the reinforcing portion 69 of the actuator unit 21, that is, the entire outer periphery and the COF 50 may be fixed with the reinforcing member 67. Therefore, when the COF 50 is expanded or contracted by the temperature variations, a force of the COF 50 applied on the plurality of contact points C, that is, the plurality of lands 58 and the plurality of bumps 136 inwardly in the horizontal direction may be reduced with the reinforcing member 67. Accordingly, a reliable electric joint of the COF 50 with respect to the actuator unit 21 may be maintained. In particular, the solder resist 61 having a coefficient of thermal expansion larger than that of the base material 51 may tend to contract significantly when being cooled naturally after having cured completely. Therefore, if the reinforcing member 67 is not provided, the contact points C which are located outermost periphery where the stress from the periphery is not cancelled may be subject to a significant stress applied inwardly of the actuator unit 21 at a room temperature. However with the provision of the reinforcing member 67 as in this embodiment, the stress applied to the contact points C on the outermost periphery may be reduced, and hence the breakage of the same may be restrained.

Also, with the formation of the plurality of dummy contact points C', that is, the plurality of dummy lands 59 and the plurality of dummy bumps 137, when the COF 50 is expanded or contracted, the force of the COF 50 applied to the contact points C inwardly in the horizontal direction may be reduced by the plurality of dummy contact points C'. Therefore, a reliable electric joint with respect to the actuator unit 21 may be maintained.

When the COF 50 is expanded or contracted, the plurality of output wirings 57*a* may be pulled by the solder resist 61. Accordingly, the contact point covering layer 60*a* and the dummy contact point covering layer 60*b* joined to the solder resist 61 may be pulled with respect to the in-plane direction of the surface 51*a*. According to this embodiment, by the contact point covering layer 60*a* and the dummy contact point covering layer 60*b* being pulled in this manner, the force of the COF 50 applied directly to the contact points C inwardly in the horizontal direction may be reduced. Therefore, a reliable electric joint with respect to the actuator unit 21 may be maintained.

The contact point covering layer 60*a* and the dummy contact point covering layer 60*b* may connect the actuator unit 21 and the COF 50 at the contact points C and the dummy contact points C'. Therefore, when the COF 50 is expanded or contracted, even when there is a difference in expansion or contraction between them in the in-plane direction of the surface 51*a*, the force may be hardly applied directly to the respective contact points C. Accordingly, a stable electric joint at the respective contact points C may be maintained.

Since the reinforcing member 67 is formed of the heat-cured epoxy resin, the reinforcing portion 69 of the actuator unit 21 and the COF 50 may be reliably fixed.

The printhead in which the reinforcing portion 69 of the actuator unit 21 and the COF 50 are fixed with the reinforcing member 67 may be provided. Therefore, when the COF 50 is expanded or contracted by the temperature variations, the force of the COF 50 applied on the plurality of contact points C inwardly in the horizontal direction may be reduced with the reinforcing member 67. Therefore, the reliable electric joint with respect to the actuator unit 21 may be maintained.

The printhead in which the plurality of dummy contact points C' are formed may be provided. Therefore, when the COF 50 is expanded or contracted, the force of the COF 50 applied on the contact points C inwardly in the horizontal direction may be reduced with the plurality of dummy contact points C'. Therefore, the reliable electric joint with respect to the actuator unit 21 may be maintained.

The printhead configured to reduce the force of the COF 50 applied to the contact points C inwardly in the horizontal direction by the plurality of output wirings 57*a* being pulled by the solder resist 61 when the COF 50 is expanded or contracted, and hence the contact point covering layer 60*a* and the dummy contact point covering layer 60*b* joined to the solder resist 61 being pulled with respect to the in-plane direction of the surface 51*a* may be provided. Therefore, the reliable electric joint with respect to the actuator unit 21 may be maintained.

Referring to FIG. 12 and FIGS. 13A to 13C, a modification of the embodiment described above will be described. However, those having the same configuration as the embodiment described above are designated by the same reference numerals and description will be omitted as needed.

Figure 12:
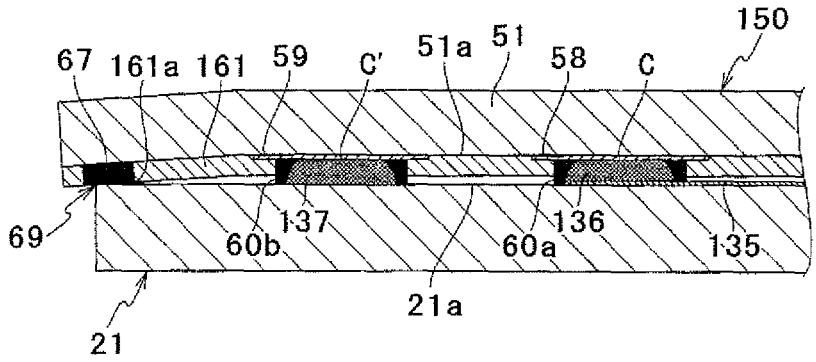
FIG. 12 is a cross-sectional view showing a COF, a reinforcing member, and an actuator unit of an ink-jet printer according to another embodiment.

Referring to FIG. 12, a COF 150 may include a solder resist 161 instead of the solder resist 61. The solder resist 161 may include a groove 161*a* provided at a position corresponding to the reinforcing portion 69 (i.e., other than one side closest to the non-fixed portion) of the actuator unit 21. In this embodiment, the reinforcing member 67 may be provided so as to be embedded into the groove 161*a*. The reinforcing member 67 may be fixed to the solder resist 161 in the groove 161*a*, and the surface thereof may be fixed to the reinforcing portion 69 of the actuator unit 21. Therefore, the COF 150 and the actuator unit 21 may be fixed to each other. The COF 150 may be inclined from the portion in the vicinity of the plurality of dummy contact points C' to a portion where the groove 161*a* is formed. The solder resist 161 and the reinforcing member 67 may include the heat-cured resins of different types. Accordingly, these members may be discriminated.

Figure 13A:
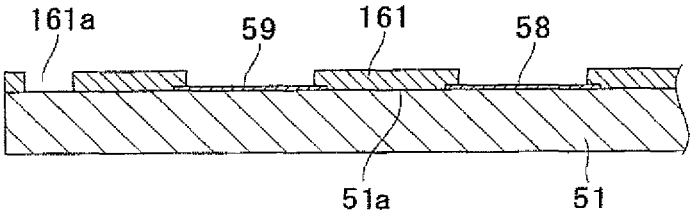
FIGS. 13A to 13C are drawings for explaining steps of joining the COF shown in FIG. 12 to the actuator unit.
Figure 13B:
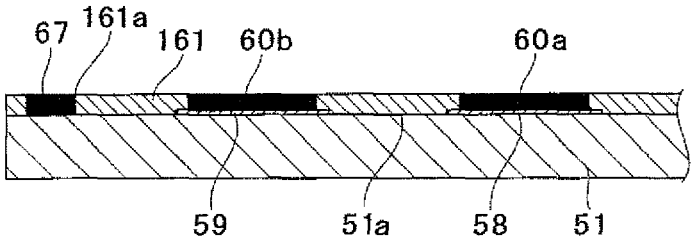
Figure 13C:
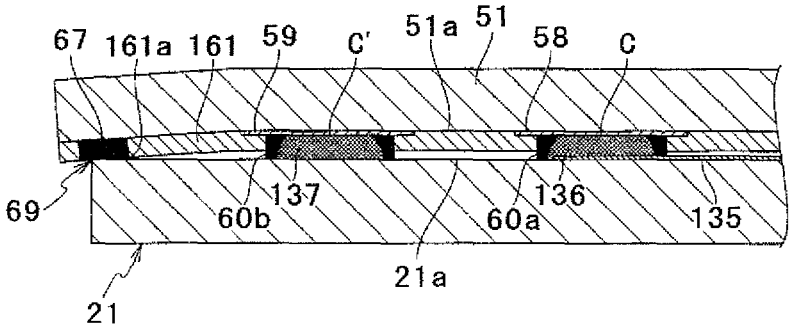

Referring to FIGS. 13A to 13C, steps of manufacturing the COF 150 and fixing the same to the actuator unit 21 will be described.

In the same manner as in the embodiment described above, the head body 2 may be manufactured. Subsequently, the COF 150 may be manufactured. Referring to FIG. 13A, the plurality of lands 58 and dummy lands 59, the plurality of wirings including the output wirings 57*a* and the control wirings 57*b*, and the mounting lands on which the driver IC 52 is mounted may be disposed on the surface 51*a* of the base material 51. Then using the photolithography, the output wirings 57*a* and the control wirings 57*b* may be covered with the photoimageable solder resist 161. The solder resist 161 may include the same epoxy-based resin as the solder resist 61. The procedure of manufacture may be also the same. At this time, in the fixed portion, the pattern of the solder resist 161 may be formed at a portion excluding the position opposing the reinforcing portion 69 in addition to the portions where the lands 58 and the dummy lands 59 are formed. Circular depressed portions may be formed at portions corresponding to the respective lands 58 and 59, and the groove 161*a* extending along the outline of the actuator unit 21 may be formed at a portion corresponding to the reinforcing portion 69. In this embodiment, the outline portion adjacent to the non-fixed portion of the COF 150 may be not formed with the groove 161*a*. The groove 161*a* may be formed along the short side (i.e., upper base) and the oblique side (i.e., formation of lands, wirings, and solder resist).

Referring to FIG. 13B, the heat-cured resin may be filled in the depressed portions in which the plurality of lands 58 and dummy lands 59 are disposed as bottom surfaces and in the groove 161*a* by applying the heat-cured epoxy resin over the entire surface using a squeegee. Accordingly, the contact point covering layer 60*a* and the dummy contact point covering layer 60*b*, as well as the reinforcing member 67 may be formed (i.e., printing of the covering layers and the reinforcing member). At this time, the contact point covering layer 60*a* and the dummy contact point covering layer 60*b* may come into contact with the solder resist 161 with respect to the in-plane direction of the surface 51*a*. Thereafter, a heating process for semi-curing the contact point covering layer 60*a* and the dummy contact point covering layer 60*b*, as well as the reinforcing member 67 may be performed (i.e., semi-curing of the covering layers and the reinforcing member). Then, the driver IC 52 may be mounted on the mounting land. Accordingly, the COF 150 may be completed.

Referring to FIG. 13C, the surface 21*a* of the actuator unit 21 and the surface 51*a* of the COF 150 may be opposed with respect to each other and may be pressurized toward each other. Accordingly, the individual bumps 136 and the dummy bumps 137 may penetrate through the contact point covering layer 60*a* and the dummy contact point covering layer 60*b* respectively, and may come into contact with the lands 58 and the dummy lands 59, respectively. Simultaneously, the reinforcing member 67 may come into contact with the reinforcing portion 69 of the actuator unit 21. At this time, the reinforcing member 67 may partly come into contact also with a side surface of the actuator unit 21. In this state, by applying the heating process, the contact point covering layer 60*a* and the dummy contact point covering layer 60*b* and the reinforcing member 67 may be cured in the same manner as the embodiment described above. At this time, the individual bumps 136 and the lands 58 may be joined to each other (i.e., contact points C), and the dummy bumps 137 and the dummy lands 59 may be joined to each other (i.e., dummy contact point C'). In addition, the reinforcing member 67 may be fixed to both the solder resist 161 and the actuator unit 21. Accordingly, the actuator unit 21 and the COF 150 may be fixed to each other (i.e., pressure and heat joint).

According to the embodiment described above, formation of the reinforcing member 67 may be achieved simultaneously with the formation of the contact point covering layer 60*a* and the dummy contact point covering layer 60*b*. Therefore, in addition to the advantages achieved by the embodiment described in conjunction with FIG. 1 to FIG. 11D, the printhead may be manufactured easily.

In the embodiment described above, the reinforcing portion 69 to be fixed to the reinforcing member 67 may correspond to the entire outer periphery of the actuator unit 21. However, the reinforcing portion 69 may be at least part of the outer periphery of the actuator unit. For example, the reinforcing portion 69 may be the outer periphery extending along at least one side of the actuator unit 21. It may also be the outer periphery along all the sides other than one side closest to the non-fixed portion 50*b* from among the sides of the actuator unit 21.

In the embodiment described above, the dummy contact points C' may be disposed. However, the dummy contact points C' do not have to be provided. Alternatively, the dummy contact points C' may be disposed along at least one side of the actuator unit 21. For example, when the reinforcing portion is the outer periphery along all the sides other than one side closest to the non-fixed portion 50*b* from among the sides of the actuator unit 21, the dummy contact points C' may be disposed along the one side closest to the non-fixed portion 50*b*.

In the embodiment described above, the dummy bumps 137 and the dummy lands 59 which constitute the dummy contact points C' may physically connect the actuator unit 21 and the COF 50. However, the dummy bumps 137 and the dummy lands 59 may be connected to the common electrode 134.

In the embodiment described above, the heat-cured epoxy resin filled in the groove 161*a* may join the side surface of the actuator unit 21 and the reinforcing portion 69. At this time, the COF 150 may be joined by being bent toward the reinforcing portion 69. However, the surface of the actuator unit 21 corresponding to the reinforcing portion 69 may be disposed with reinforcing bumps so as to oppose the groove 161*a*. The reinforcing bumps may have the same height as the respective bumps 136 and 137 from the surface. The material of the reinforcing bumps may be the same as the respective bumps 136 and 137 or may be different. The reinforcing bumps may be configured to penetrate through the resin in the groove 161*a* when forming the respective contact points C and C'.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A printhead comprising:

a flow channel unit configured to discharge liquid;

an actuator unit configured to apply discharge energy to the liquid in the flow channel unit;

a flat flexible substrate connected to the actuator unit and configured to supply a drive signal to the actuator unit;

a plurality of contact points disposed in an outline of the actuator unit in plan view and configured to electrically connect the actuator unit and the flat flexible substrate; and a reinforcing member configured to fix a reinforcing portion, which includes at least part of an outer periphery of the actuator unit and the flat flexible substrate.

2. The printhead according to claim 1, wherein the reinforcing portion is the entire outer periphery of the actuator unit.

3. The printhead according to claim 1, wherein the actuator unit has a polygonal shape in plan view, wherein the flat flexible substrate includes a non-fixed portion which extends beyond the actuator unit and is not fixed to the actuator unit, and wherein the reinforcing portion is the outer periphery extending along all the sides other than one side closest to the non-fixed portion among the sides of the actuator unit.

4. The printhead according to claim 3, further comprising a plurality of dummy contact points disposed at positions close to the non-fixed portion than the plurality of contact points.

5. The printhead according to claim 4, wherein the actuator unit comprises a first surface opposing the flat flexible substrate, a plurality of individual electrodes disposed on the first surface, a plurality of bumps configured to receive supply of the drive signal and electrically connected respectively to the individual electrodes, and a plurality of dummy bumps not receiving supply of the drive signal, wherein the flat flexible substrate comprises a second surface opposing the actuator unit, a plurality of lands disposed on the second surface and joined to the bumps respectively, and a plurality of dummy lands joined to the dummy bumps respectively, wherein the plurality of contact points each include the bump and the land; and wherein the plurality of dummy contact points each include the dummy bump and the dummy land.

6. The printhead according to claim 5, wherein the flat flexible substrate further comprises a plurality of wirings connected respectively to the lands, and a wiring covering layer having the insulating properties for covering the plurality of wirings, and wherein the reinforcing member is interposed between the reinforcing portion and the wiring covering layer.

7. The printhead according to claim 5, wherein the flat flexible substrate further comprises a plurality of wirings connected respectively to the lands, and a wiring covering layer having the insulating properties for covering the plurality of wirings, and wherein the reinforcing member is disposed in a depressed portion formed on the wiring covering layer.

8. The printhead according to claim 5, wherein the flat flexible substrate further comprises a land covering layer having the insulating properties for covering at least the plurality of lands other than joint portion with respect to the plurality of bumps, and wherein the land covering layer is in contact with the wiring covering layer with respect to the in-plane direction of the second surface.

9. The printhead according to claim 8, wherein the land covering layer includes a heat-cured adhesive agent, and is configured to cover the plurality of contact points and the plurality of dummy contact points respectively over the entire circumference, and connect the first surface and the second surface.

10. The printhead according to claim 1, wherein the reinforcing member includes a heat-cured adhesive agent.

* * * * *